United States Patent [19]

Summers

[11] 4,379,223

[45] Apr. 5, 1983

[54] UNIVERSAL CHAIN LINK COUNTING APPARATUS AND METHOD

[76] Inventor: Scott Summers, 605-2nd Ave. S., Wheaton, Minn. 56296

[21] Appl. No.: 337,525

[22] Filed: Jan. 7, 1982

[51] Int. Cl.[3] ..... G06M 1/00

[52] U.S. Cl. ..... 235/103; 235/1 R

[58] Field of Search ..... 235/93, 103, 104, 95 R, 235/91 A, 91 B, 1 R; 116/281, 282, 321

[56] References Cited

U.S. PATENT DOCUMENTS 2,272,478 2/1942 Poole ..... 235/91 A X

*Primary Examiner*—Benjamin R. Fuller

*Attorney, Agent, or Firm*—Thomas B. Tate

[57] ABSTRACT

The invention is a universal apparatus for mechanically counting links of chain and the method of mechanically counting links of chain by means of an apparatus of the type described herein.

2 Claims, 3 Drawing Figures

UNIVERSAL CHAIN LINK COUNTING APPARATUS AND METHOD

SUMMARY OF THE INVENTION AND DISCUSSION OF THE PRIOR ART

The invention is a universal chain link counting apparatus and method. The primary object of the invention is to count links of chain faster and more efficiently than can be done manually at present.

At the present time, when one desires to measure a specified length of chain to be cut from a larger standard-size roll, this measurement must be performed by manually counting pitches, each pitch representing one link of chain. This manual counting process is very laborious and time-consuming, often requiring as long as one-half hour. Before developing the present invention, the inventor, who is a farm implement dealer, tried in vain to find a device on the market which would mechanically count links of chain. A recent patent search has revealed no patents for chain link counting devices.

The present invention comprises a frame with openings in opposite sides through which a cross-bolt is disposed, a plurality of sprockets, each accommodating a different size chain, mounted on said cross-bolt, a plurality of pegs mounted on the interior surface of each of said sprockets with the number of said pegs on any given sprocket corresponding to the number of teeth on that sprocket, and a counting mechanism slidably mounted on top of the frame in such a manner that the lever arm of the counting mechanism contacts the pegs on the sprockets, thus counting each link of chain which is pulled across the sprocket.

DESCRIPTION OF VIEWS OF THE DRAWING

In the sheet of drawings.

DETAILED DESCRIPTION OF THE INVENTION

Figure 1:
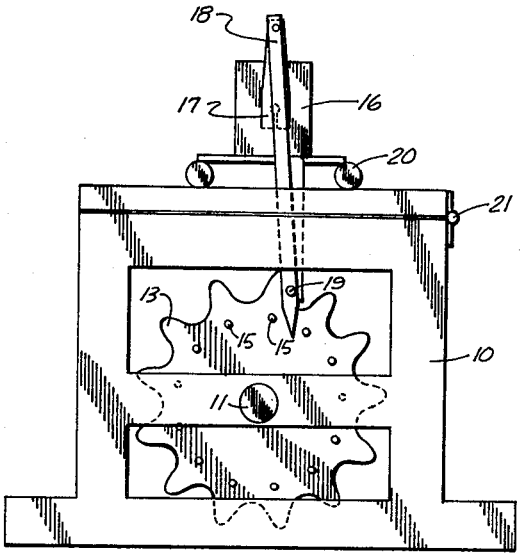
FIG. 1 is an end view.
Figure 2:
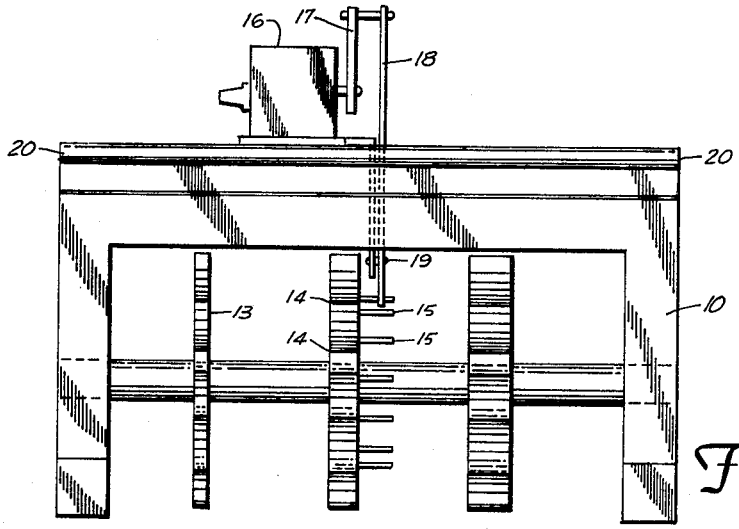
FIG. 2 is a front view.
Figure 3:
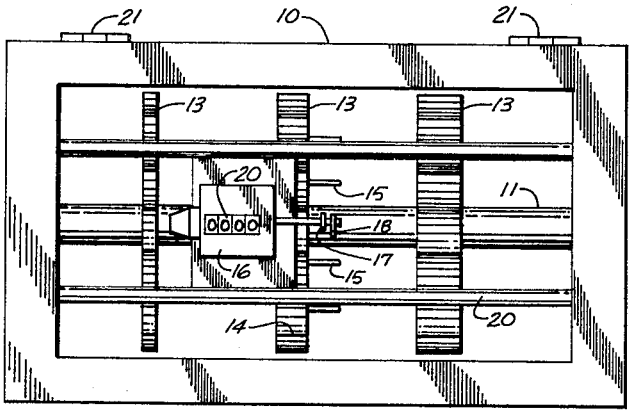
FIG. 3 is a top view.

The universal chain link counting apparatus has a generally rectangular frame 10, which may be bolted to a table or other flat surface or which may be provided with a handle so as to make the apparatus portable. A cross-bolt 11 is disposed through openings 12 in either upright side of the frame 10 and is positioned parallel to the top of the frame 10. The top of the frame 10 is provided with hinges 21.

One or more chain sprockets 13 are mounted on the cross-bolt 11. Each of the sprockets 13 has a different number and spacing of teeth 14 in order to accommodate a different size chain. In the preferred embodiment of the invention, each of the sprockets 13 has the same diameter; however, sprockets 13 of unequal diameter may be used provided that the frame 10 is large enough to accommodate the sprocket 13 of largest diameter.

A plurality of pegs 15 are mounted on the interior surface of each sprocket 13. The number of pegs 15 and the distance between pegs 15 on any given sprocket 13 corresponds to the number of teeth 14 and the distance between teeth 14 on that particular sprocket 13. The sprockets 13 and the pegs 15 may be made of metal, plastic, or other meterials.

In the preferred embodiment of the invention, three sprockets 13, adapted to fit the most common chain sizes (#40,#50, and #60 chain, respectively) are mounted in spaced relation on the cross-bolt 11. However, sprockets 13 which fit other sizes of chain may also be used, and the total number of sprockets 13 may be greater or less than three.

A counting mechanism such as an anchor-meter 16 is screwed to the top of the frame 10. This counting mechanism 16 is provided with a lever arm 17 which is long enough to contact the pegs 15 mounted on the sprocket 13. In order to count the desired number of links of chain from a standard-size roll, the following procedure is used. The chain that is to be counted is placed manually on the appropriate sprocket 13 in such a manner that one tooth 14 of the sprocket 13 penetrates the first pitch (hole) of the chain. As the chain is pulled manually across the top of the sprocket 13, the sprocket 13 rotates, bringing each successive tooth 14 into contact with a successive pitch in the chain and simultaneously bringing each successive corresponding peg 15 into contact with the bottom tip of the lever arm 17 of the counting mechanism 16. The counting mechanism 16 makes an audible click as each peg 15 passes its lever arm 17, thus counting each link of chain. The dial 22 of the counting mechanism 16 registers the total number of links which have been counted.

If the counting mechanism 16 has a lever arm 17 which is longer than the distance between pegs 15 on sprocket 13, the following alternative embodiment may be used. The counting mechanism 16 is provided with a linkage arrangement 18 extended from the bottom of the lever arm 17 in such a manner that the lever arm 17 contacts each second peg 15, or alternatively, the lever arm 17 contacts each peg 15 provided that the linkage arrangement 18 is attached to the lever arm 17 in such a manner that the pivot point 19 is placed eccentrically.

Two rods 20 placed lengthwise across the top of the frame 10 serve as a slide along which the counting mechanism 16 may be moved. To operate, the top of the frame 10, which is hinged, is flipped up to remove contact between the lever arm 17 of the counting mechanism 16 and the peg 15 of the sprocket 13. The counting mechanism 16 is then slid along the rods 20 until it is lined up with the next sprocket 13. The top of the frame 10 is then lowered to bring the lever arm 17 of the counting mechanism 16 into contact with the peg 15 on that sprocket 13. This feature makes the invention a universal counting apparatus, capable of counting links of any size chain.

It is intended that the invention cover not only the various embodiments of the universal apparatus described above, but also the method of counting links of chain mechanically by means of an apparatus of the general type disclosed herein.

I claim:

1. A universal chain link counting apparatus, said apparatus comprising:

a frame;

a cross-bolt disposed through openings in opposite sides of said frame;

a plurality of sprockets rotatably mounted in spaced relation on said cross-bolt, each of said sprockets having a different number and spacings of teeth thereon designed to accommodate a different size of chain;

a plurality of pegs mounted on the interior surface of each of said sprockets, the number of pegs on any given sprocket corresponding to the number of teeth on that sprocket;

a counting mechanism slidably mounted on top of said frame such that a lever arm of said counting mechanism contacts said pegs as a length of chain is pulled across said sprocket, thus counting each link of chain;

sliding means permitting said counting mechanism to be slid into position to contact the pegs on any of said sprockets and thus count links of any size chain.

2. A method of counting links of chains mechanically by means of a universal counting apparatus comprising a frame, counting mechanism and sprockets having a plurality of teeth with corresponding pegs mounted on an interior surface thereof, wherein the procedure for counting the links of chains comprise the following steps:

Placing the chain whose links are to be counted on the sprocket of universal counting apparatus in such a manner that one tooth of said sprocket penetrates the first pitch provided in a link of said chain;

pulling said chain across the top of said sprocket, causing the rotation of said sprocket to bring each successive tooth of said sprocket into contact with each successive pitch of said chain; and Simultaneously bringing each corresponding peg of said sprocket into contact with a lever arm of the counting mechanism which is slidably mounted on top of said frame, thus causing said counting mechanism to register each link of chain counted.

* * * * *